US005679270A

United States Patent [19]

Thornton et al.

[11] Patent Number: 5,679,270

[45] Date of Patent: Oct. 21, 1997

[54] METHOD FOR REMOVING CERAMIC MATERIAL FROM CASTINGS USING CAUSTIC MEDIUM WITH OXYGEN GETTER

[75] Inventors: Thomas J. Thornton; Julie A. Faison, both of Whitehall; Neil E. Paton, N. Muskegon, all of Mich.

[73] Assignee: Howmet Research Corporation, Whitehall, Mich.

[21] Appl. No.: 673,019

[22] Filed: Jul. 1, 1996

Related U.S. Application Data

[63] Continuation of Ser. No. 330,212, Oct. 24, 1994, abandoned.

[51] Int. Cl.[6] ..... B22D 29/00

[52] U.S. Cl. ..... 216/101; 29/889.721; 164/36; 164/132

[58] Field of Search ..... 216/100, 101; 29/889.721, 889.722, DIG. 8; 164/132, 36

[56] References Cited

U.S. PATENT DOCUMENTS

| | | | |
|---|---|---|---|
| 3,121,026 | 2/1964 | Beigay et al. | 134/2 |
| 3,218,684 | 11/1965 | Spink | 164/132 |
| 3,694,264 | 9/1972 | Weinland et al. | 134/22 |
| 3,769,101 | 10/1973 | Woodward . | |
| 4,043,377 | 8/1977 | Mazdiyasni | 164/7 |
| 4,097,292 | 6/1978 | Haseby et al. | 106/38.9 |
| 4,134,777 | 1/1979 | Borom | 134/2 |
| 4,141,781 | 2/1979 | Greskovich et al. | 156/637 |
| 4,162,173 | 7/1979 | Arendt et al. | 134/2 |
| 4,250,009 | 2/1981 | Cuomo et al. . | |
| 4,439,241 | 3/1984 | Ault et al. | 134/22.17 |
| 5,316,069 | 5/1994 | Aghajanian et al. | 164/97 |
| 5,370,694 | 12/1994 | Davidson . | |
| 5,404,929 | 4/1995 | Till | 164/66.1 |

OTHER PUBLICATIONS

Lawrence H. van Vlack, Elements of Materials Science and Engineering, Sixth Edition, 1990, p. 519 (Addisson Wesley Pub. Co).

*Primary Examiner*—John Niebling
*Assistant Examiner*—Scott Kirkpatrick
*Attorney, Agent, or Firm*—Edward J. Timmer

[57] ABSTRACT

A method of removing ceramic material, such as for example a ceramic core, from a metallic cast or other component involves contacting the metallic cast component and a caustic ceramic leaching medium at elevated temperature for a time effective to substantially remove the ceramic material from the component and providing an oxygen getter in the caustic ceramic leaching medium in an amount effective to avoid deleterious surface corrosion of the component while the ceramic material is being removed therefrom.

20 Claims, 4 Drawing Sheets

METHOD FOR REMOVING CERAMIC MATERIAL FROM CASTINGS USING CAUSTIC MEDIUM WITH OXYGEN GETTER

This application is a continuation of U.S. Ser. No. 08/330,212, filed Oct. 24, 1994, now abandoned.

FIELD OF THE INVENTION

The present invention relates to the removal of ceramic material, such as for example ceramic core material, from a metallic component, such as for example a superalloy investment casting, while avoiding deleterious surface corrosion of the casting.

BACKGROUND OF THE INVENTION

In the manufacture of gas turbine engine components, such as gas turbine engine blades and vanes, an appropriate nickel or cobalt based superalloy is investment cast in a ceramic investment shell mold. One or more ceramic cores are present in the ceramic investment mold when the cast component is to include one or more internal passages. For example, gas turbine blades and vanes for modern, high performance gas turbine engines typically include internal cooling passages extending through the airfoil and root portions and through which passages compressor bleed air is conducted to cool the airfoil portion during engine operation. In this event, the ceramic core positioned in the investment mold will have a configuration corresponding to the internal cooling passage(s) to be formed through the airfoil and root portions of the cast turbine blade or vane. The blade or vane component may be cast by well known techniques to have an equiaxed, columnar, or single crystal microstructure. In the past, the ceramic core has been removed from the investment cast component by autoclave, open kettle, or molten salt techniques. One autoclave technique involves immersing the cast component in an aqueous caustic solution (e.g. 20% NaOH) at elevated pressure and temperature (e.g. 620 psi and 500 degrees F.) for an appropriate time (e.g. 60 hours) to dissolve the core from the casting. U.S. Pat. Nos. 4,134,777 and 4,141,781 disclose autoclave caustic leaching of yttria ceramic cores and beta alumina ceramic cores from directionally solidified superalloy castings. The open kettle technique involves immersing the cast component in a similar aqueous caustic solution at ambient pressure and elevated temperature (e.g. 132 degrees C.) with agitation of the solution for a time (e.g. 90 hours) to dissolve the core from the casting. The molten salt technique involves immersing the cast component in molten caustic salt, such as molten KOH or NaOH, contained in a suitable open vessel for a time (e.g. 30 hours) to dissolve or leach the ceramic core out of the cast component.

Since these ceramic core removal techniques are quite slow and time-consuming, attempts have been made by the inventors to speed up core leaching by making the caustic leaching medium, whether an aqueous caustic solution or molten caustic salt, more aggressive toward the ceramic core material. For example, the concentration of the caustic (e.g. KOH or NOH) in the aqueous caustic solution can be increased and/or the temperature of the caustic solution can be increased to this end. Similarly, the temperature of the molten caustic salt medium can be increased to render the medium more aggressive toward the ceramic core material. However, attempts to accelerate the core removal process by rendering the caustic medium more aggressive toward the ceramic core material also have made the medium more aggressive toward the cast superalloy component from the standpoint that surface corrosion of the cast component now has been observed by the inventors using more aggressive caustic mediums. The surface corrosion is evidenced on gamma/gamma prime type nickel base superalloy components as a surface region depleted of gamma phase and evidencing attack of carbides present.

An object of the present invention is to provide an improved method of removing ceramic material, such as for example ceramic core material, from a metallic component by contact with an aggressive caustic leaching medium while avoiding deleterious surface corrosion of the component.

SUMMARY OF THE INVENTION

The present invention provides an improved method of removing ceramic material from a metallic component involving contacting the metallic component and a caustic leaching medium at elevated temperature for a time effective to remove the ceramic material from the component and providing an oxygen getter in the caustic leaching medium in a quantity effective to avoid deleterious surface corrosion of the component while the ceramic material is being removed therefrom.

In one embodiment of the invention, the caustic leaching medium comprises an aqueous caustic solution in an autoclave or in an open kettle. The caustic solution can comprise an aqueous solution of KOH or NaOH present in at least 30 weight % of the solution to render it more aggressive toward the ceramic core material.

In another embodiment of the invention, the caustic leaching medium comprises a molten caustic salt. The molten caustic salt can comprise KOH or NaOH at a temperature of at least 400 degrees F. to render it more aggressive toward the ceramic core material.

In still another embodiment of the invention, the oxygen getter comprises titanium or an alloy of titanium which can be in the form of sponge, chips, bar stock and the like. The oxygen getter can be present with the metallic component in an open container that is immersed in the caustic leaching medium. The oxygen getter material getters oxygen from the caustic leaching medium and provides cathodic protection from corrosion for the metallic component when in electrical contact therewith. Alternately or in addition, the oxygen getter can be directly introduced in suitable form to the caustic leaching medium held in a containment vessel.

The present invention is especially useful, although not limited, to removing a ceramic core from inside a cast metallic component so as to leave a passage where the core formerly resided. For example, the cast component can comprise a cast superalloy airfoil component having a ceramic core residing therein to define a cooling air passage in the component. The cast metallic component also can comprise a cast superalloy airfoil component having ceramic shell mold material residing on external surfaces thereon. Still further, the metallic component can comprise an engine-run airfoil component having ceramic type deposits that require removal for refurbishment of the component.

The present invention will be described further in the following detailed description taken with the following drawings.

BRIEF DESCRIPTION OF THE DRAWINGS

FIG. 1A is taken at an internal (cored) airfoil surface. FIG. 1B represents typical corrosion spike on the cored airfoil surface. FIG. 1C represents the typical corrosion layer found on the airfoil surface. FIG. 1D represents a particularly deep corrosion layer seen at a leading edge hole of the airfoil of the cast turbine blade.

FIG. 3A is taken at an exterior airfoil surface. FIGS. 3B and 3C are taken at a cored airfoil surface. FIG. 3D is taken at an exterior surface at the side of the root section of the cast turbine blade.

DESCRIPTION OF THE INVENTION

Figure 1D:
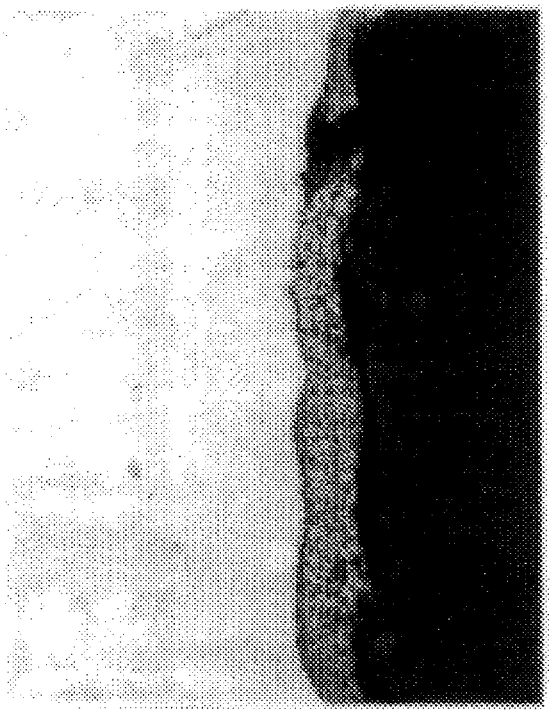
FIGS. 1A, 1B, 1C, and 1D are photomicrographs at 500X of corroded surface regions of a cast nickel base superalloy turbine blade immersed in molten KOH at 650 degrees F. for 3.3 hours without an oxygen getter present.
Figure 1C:
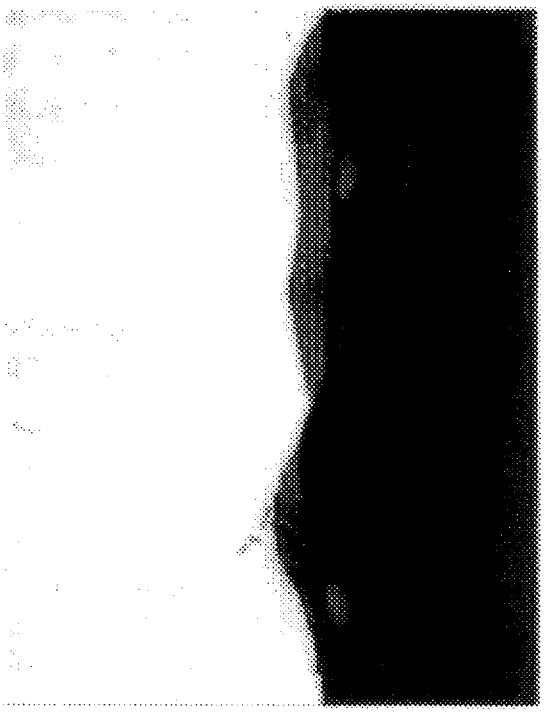
Figure 1B:
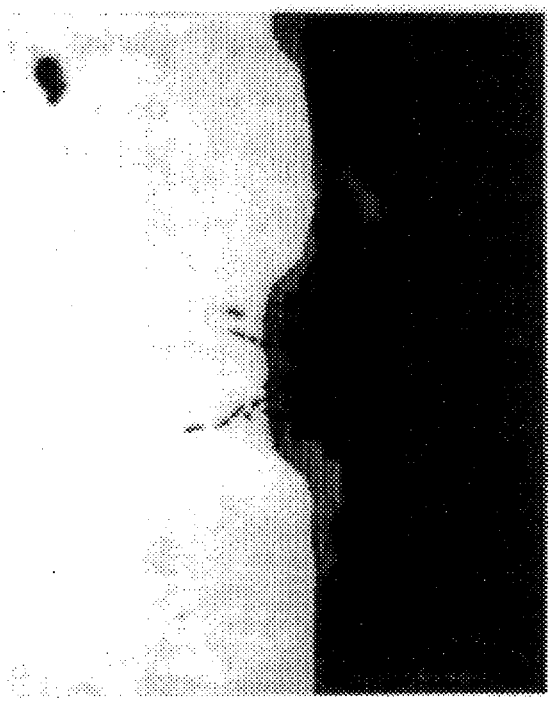
Figure 1A:
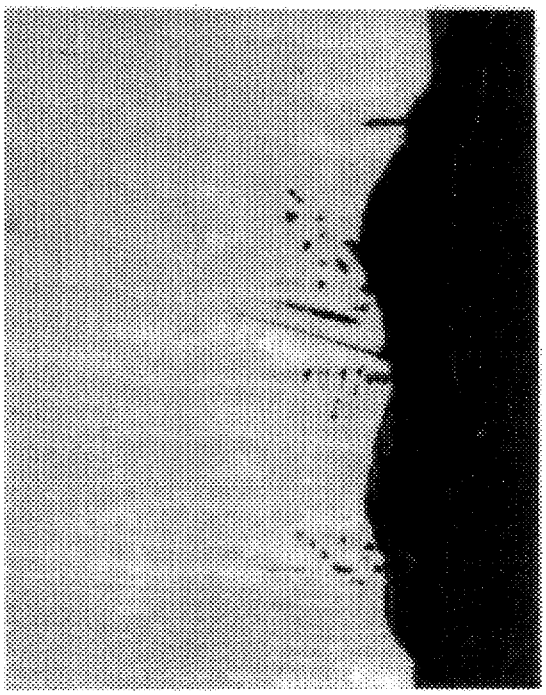

The present invention involves the removal of ceramic material, such as a ceramic core and/or ceramic shell mold material or ceramic deposits, from a metallic component, such as a superalloy investment casting, by contacting the component and a caustic leaching medium, while avoiding deleterious surface corrosion of the component during the ceramic material removal process. The present invention is especially useful, although not limited, to removing ceramic core material from a cast metallic component using an aggressive caustic leaching medium to hasten the rate of ceramic removal, while nevertheless avoiding deleterious surface corrosion of the component.

The method of the invention involves contacting the metallic component and a caustic leaching medium at elevated temperature for a time effective to substantially remove the ceramic phase from the component and providing an oxygen getter in the caustic leaching medium in a quantity effective to avoid deleterious surface corrosion of the component while the ceramic material is being removed therefrom. The caustic leaching medium is selected so as to be capable of leaching or dissolving the ceramic material residing in or on the metallic component. The oxygen getter material may be placed in electrical contact with the metallic component so as to provide cathodic corrosion protection in addition to reduction in oxygen present in the medium.

In an illustrative embodiment of the invention, the metallic component comprises a cast superalloy airfoil component (e.g. turbine blade, turbine vane or vane segment) having a ceramic core residing therein to define a cooling air passage therein upon removal. The ceramic core is embedded in the cast component by virtue of being present in the ceramic investment shell mold in which the superalloy is cast. The ceramic core extends to one or more external surfaces of the cast component where it is exposed at an external casting surface. For example, the ceramic core in a turbine blade casting is exposed at the root end of the casting and may also be exposed at the blade tip and airfoil trailing and/or leading edge as is known in the art.

The cast superalloy component typically comprises a nickel base superalloy or cobalt base superalloy cast under conditions to produce an equiaxed grain component or a directionally solidified component having a columnar grain or single crystal microstructure, such cast components being well known and in widespread use in the turbine section of gas turbine engines.

The ceramic core typically comprises an appropriate ceramic material selected in dependence on the metal or alloy to be cast thereabout in the investment casting mold. For nickel and cobalt base superalloys, such as high strength, second generation single crystal alloys including rhenium and/or yttrium, the core can comprise silica, zirconia, alumina, yttria and YAG (yttria alumina garnet). The invention is not limited to any particular core material and can be practiced to remove a core that is internal of the casting and is leachable or dissolvable in a suitable caustic ceramic core leaching medium.

Morever, the present invention is not limited to any particular casting technique, or to any particular casting shape, casting metal, alloy or other material, or casting microstructure and can be practiced to remove ceramic material from a wide variety of metallic components that have ceramic material for removal therefrom. For example, the present invention can be used to remove or leach ceramic shell mold material from external casting surfaces and to remove deposits from engine-run turbine blades and vanes or other components without deleterious attack of the metallic component itself. Moreover, the present invention can be used to remove ceramic coatings from metallic surfaces as practiced, for example, in the refurbishment of engine-run components.

In practicing the aforementioned illustrative embodiment of the invention for removing a ceramic core from the cast superalloy airfoil component, the cast component and the caustic leaching medium are contacted, for example, by immersion of the cast component in the caustic medium which is effective over time to leach the ceramic core from inside the component, leaving a passage where the core formerly resided. The caustic leaching medium is selected so as to be capable of leaching or dissolving the ceramic material of the core residing in the cast component. The caustic ceramic core removal medium typcially is held in a suitable vessel, such as an autoclave in the case of an aqueous caustic solution medium, or a steel or nickel vessel in the case of a molten caustic salt medium. The oxygen getter material typcially is provided in effective amount in the caustic leaching medium at the initiation of the ceramic removal process and may be replenished periodically throughout the ceramic removal process by introducing additional oxygen getter material into the caustic leaching medium as needed to inhibit deleterious surface corrosion of the component. In the case of autoclave leaching, multiple autoclave cycles are typically run in order to replenish caustic solutions. Additional getter material can be added at the start of any of a series of autoclave runs.

In practicing the present invention, the caustic leaching medium may comprise an aqueous caustic solution, such an aqueous KOH or NaOH solution or a molten caustic salt, such as molten KOH or NaOH. Typically, the concentration of the KOH or NaOH in solution is at least 10 weight % solution, although the invention is not limited in this regard. Aqueous caustic solutions can be rendered more aggressive toward the ceramic core material to increase the rate of ceramic removal by including KOH or NaOH in increased concentrations and usng higher solution temperatures; e.g. at least 30, preferably 40, weight % of the solution and a solution temperature of at least 520 degrees F. Molten KOH or NaOH salts can be rendered more aggressive to this same end by heating them to higher temperatures; e.g. a temperature of at least 650 degrees F.

Other caustic leaching mediums which can be used to practice the invention include, but are not limited to, metallic borates, carbonates, and hydroxides.

An oxygen getter useful in practicing the present invention preferably comprises titanium or an alloy of titanium in suitable form, such as sponge, chips, bar stock, including titanium sheet. Other oxygen getter materials that might be useful in practicing the invention include, but are not limited, to Mg, Y, Hf, Zr, Al, and Ca or other getter materials that have a greater affinity for corrosion-promoting oxygen present in the particular caustic medium than the metal or alloy of which the componet is cast or otherwise formed. The quantity of oxygen getter present is selected in dependence on the quantity of corrosion promoting oxygen present in caustic leaching medium as well as the temperature of the caustic leaching medium so that deleterious surface corrosion of the component is avoided during the ceramic removal operation.

The Examples set forth herebelow illustrate quantities of titanium oxygen getter present in a particular aqueous caustic solution and particular molten caustic salt determined to be effective to inhibit deleterious surface corrosion of the components as evidenced by post cleaning metallographic examination of the components. The quantity of oxygen getter needed for other caustic leaching mediums and conditions can be readily determined in an empirical manner so as to avoid deleterious surface corrosion of the components involved.

The oxygen getter can be provided in the caustic leaching medium in various ways. For example, one embodiment of the invention involves disposing a plurality of metallic components in a container, such as a stainless steel wire basket, that is immersed in the caustic leaching medium to effect removal of ceramic material and disposing the oxygen getter in a separate smaller stainless steel wire basket within the larger basket holding the metallic components. Alternately or in addition, the oxygen getter is provided in the autoclave or steel lined vessel holding the caustic leaching medium, rather than in the components basket. For example, oxygen getter in appropriate form is simply introduced into the autoclave or vessel holding the caustic leaching medium and settles to the bottom thereof.

The following Examples set forth herebelow is offered for purposes of further illustrating and not limiting the present invention.

EXAMPLE #1—Molten Caustic Salt

Molten Caustic Salt Without Oxygen Getter

As-cast, cored high pressure turbine blades (GE CF-6 80E1) were subjected to a core removal cycle using repetitive cycling involving immersion in molten KOH at 650 degrees F. without oxygen getter followed by immersion in tap water and drying at 500 degrees F. for 5 minutes. Total immersion time of the blades in the molten salt was 3.3 hours. The blades comprised Rene N5 superalloy with a core comprised of alumina, YAG, and spinel. The as-cast blades were knocked-out prior to core removal to remove ceramic shell mold material. The molten KOH salt was contained in a stainless steel lined pot furnace. The blades were immersed in the molten salt in an austenitic stainless steel wire basket.

After 60 cycles, only trace amounts of ceramic core material were present on the blades. However, upon metallographic examination, the blades were found to have suffered severe surface corrosion in the form of surface gamma phase depletion and carbide attack which was evidenced in some surface regions as inwardly extending spikes of carbide attack. FIGS. 1A through 1D illustrate representative surface corrosion experienced under the aforementioned aggressive core removal conditions. Surface layer corrosion averaged 5 mils (5 mils=0.005 inch) in depth with carbide attack spikes extending at most 240 mils inwardly from the outer surface of the blade. This corrosion was outside manufacturer's specifications for surface corroison and rendered the blades unacceptable.

Molten Caustic Salt With Oxygen Getter

As-cast, cored high pressure turbine blades (GE CF-6 80E1) were subjected to the same core removal cycle described hereabove. However, approximately 200 grams of titanium metal sponge (available as low oxygen titanium sponge from Mitsui Corporation) were placed in the molten caustic salt (i.e. either in the molten salt vessel or in the wire basket holding the blades to be cleaned, or in both). The indicated amount of titanium metal sponge was initially added to 100 pounds of the molten caustic (KOH) salt. The titanium sponge was replenished periodically (i.e. every 2 hours or when the sponge had been corroded away) by adding the same amount as initially added. The as-cast blades were knocked-out prior to core removal to remove ceramic shell mold material.

Figure 2B:
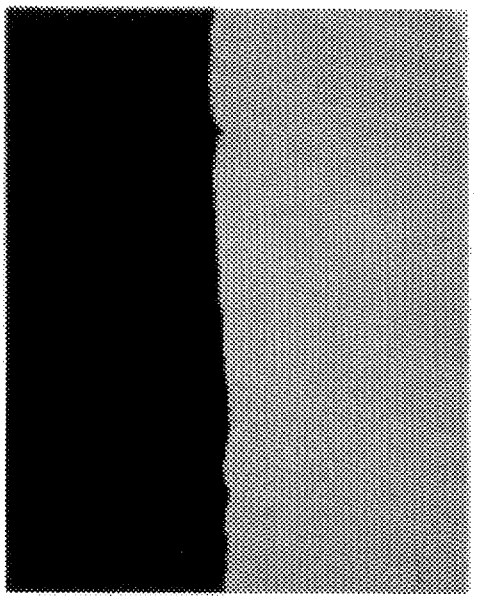
FIGS. 2A and 2B are photomicrographs at 500X of airfoil surface regions of a similar cast nickel base superalloy turbine blade immersed in molten KOH at 650 degrees F. for 3.3 hours with an oxygen getter present.
Figure 2A:
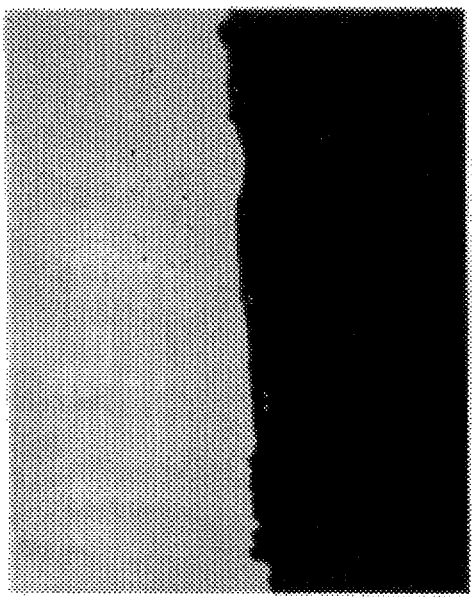
Figure 3D:
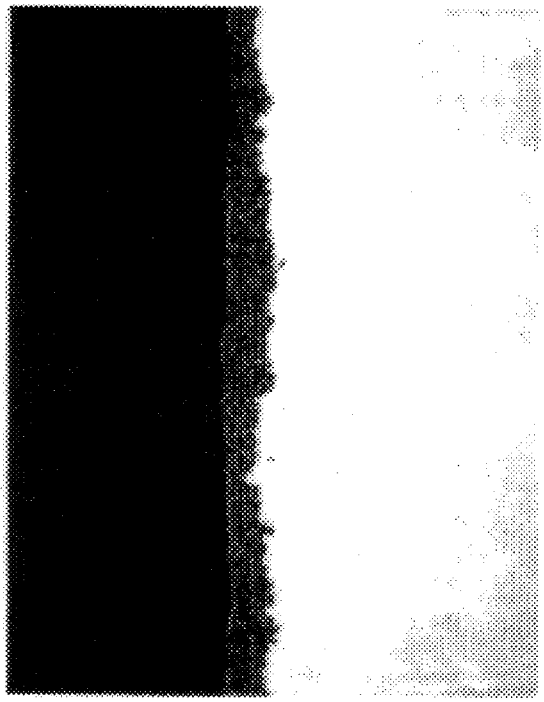
FIGS. 3A, 3B, 3C, and 3D are photomicrographs at 500X of corroded surface regions of a cast nickel base superalloy turbine blade immersed in an autoclave in a 30% aqueous NaOH solution at 515 degrees F. for 48 hours without an oxygen getter present.
Figure 3C:
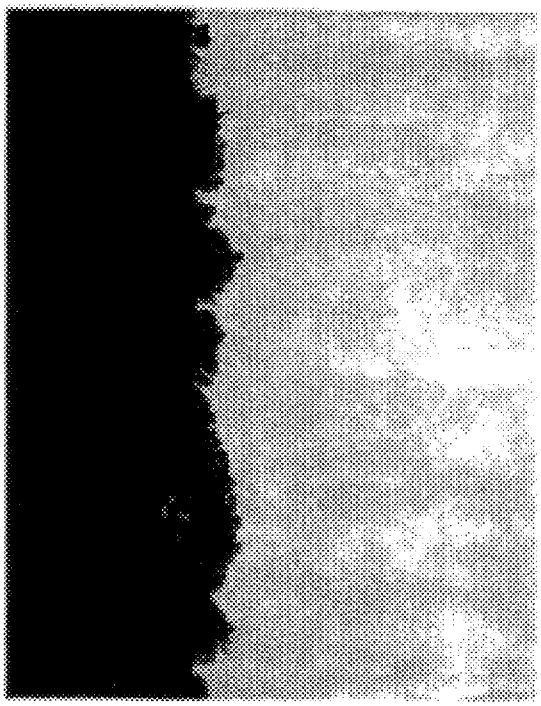
Figure 3B:
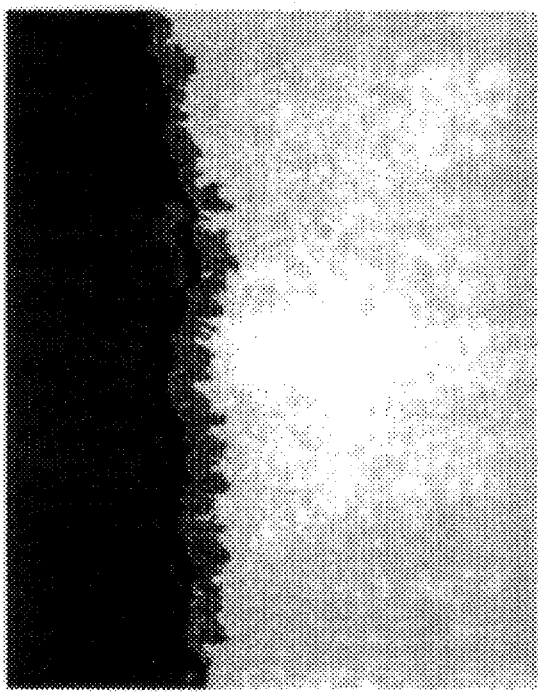
Figure 3A:
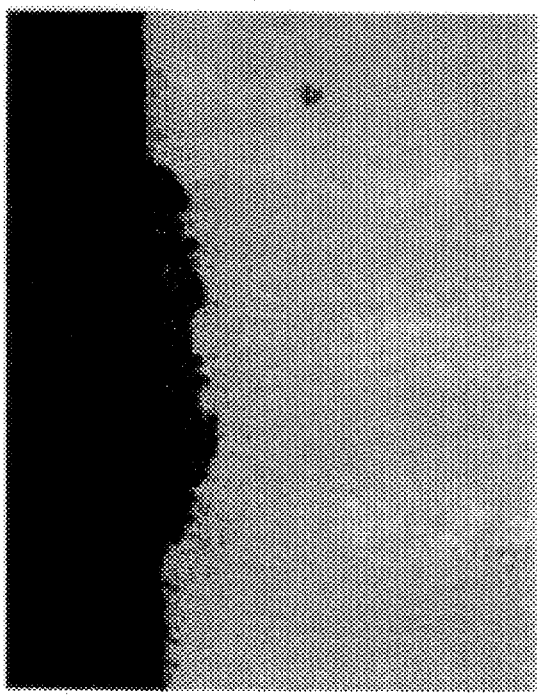

After 60 cycles, only trace amounts of ceramic core material were present on the blades. Upon metallographic examination, the blades were found to have significantly reduced surface corrosion in the form of gamma phase depletion or carbide attack. FIGS. 2A and 2B illustrate repesentative surface regions of the cleaned blades. Surface corrosion averaged less than 2 mils in depth with carbide attack spikes extending at most 120 mils inwardly from the outer surface of the blade. The blade surfaces were within manufacturer's specifications for surface corroison and rendered the blades acceptable.

EXAMPLE #2—Aqueous Caustic Solution

Aqueous Caustic Solution Without Oxygen Getter

As-cast, cored high pressure turbine blades (GE CF-6 80E1) were subjected to 3–16 hour autoclave core removal cycles involving immersion in aqueous 30% by weight NaOH solution at 515 degrees F. and 620 psi without oxygen getter for a total time of 48 hours followed by immersion in tap water. The blades comprised Rene N5 superalloy with a core comprised of alumina, YAG, and spinel therein. The as-cast blades were knocked-out prior to core removal to remove ceramic shell mold material. The NaOH solution was contained in a nickel lined vessel. The blades were immersed in the NaOH solution in an austenitic stainless steel wire basket.

After 3 cycles, only trace amounts of ceramic core material were present on the blades. However, upon metallographic examination, the blades were found to have suffered severe surface corrosion in the form gamma phase depletion. FIGS. 3A through 3D illustrate the type of surface corrosion experienced under the aforementioned core removal conditions. Surface layer corrosion averaged 12 mils in depth. This corrosion was outside manufacturer's specifications for surface corroison and rendered the blades unacceptable.

Aqueous Caustic Solution With Oxygen Getter

As-cast, cored high pressure turbine blades (GE CF-6 80E1) were subjected to the same core removal cycle described hereabove. However, approximately 500 grams of titanium metal sponge were placed in the aqueous caustic solution (i.e. either in the vessel or in the wire basket holding the blades to be cleaned or in both). The indicated amount of titanium metal sponge was added to 66 gallons of the aqueous caustic solution. The titanium sponge was replenished after each autoclave cycle by adding the same amount as initially added. The as-cast blades were knocked-out prior to core removal to remove ceramic shell mold material.

Figure 4:
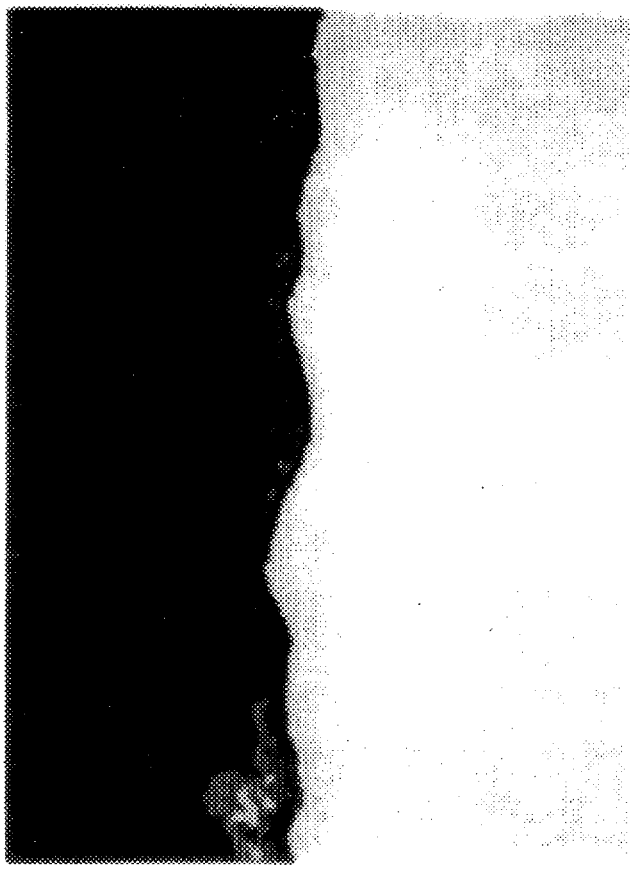
FIG. 4 is a photomicrograph at 500X of an interior (cored) airfoil surface region of a cast nickel base superalloy turbine blade immersed in an autoclave in a 30% aqueous NaOH solution at 515 degrees F. for 48 hours with oxygen getter present.

After 3 cycles, only trace amounts of ceramic core material were present on the blades. Upon metallographic examination, the blades were found to have little surface corrosion. FIG. 4 illustrates a repesentative surface region of the cleaned blades. Surface corrosion averaged less than 1–2 mils in depth. The blade surfaces were within manufacturer's specifications for surface corrosion and rendered the blades acceptable.

Although the invention has been descibed with respect to certain specific embodiments and examples thereof, those skilled in the art will recognize that these embodiments and examples are offered for purposes of illustration rather than limitation and that the invention is not limited thereto but rather only as set forth in the appended claims.

The embodiments of the invention in which an exclusive property or privilege is claimed are defined as follows:

1. A method of removing ceramic material from a superalloy component, comprising: contacting the component having the ceramic material thereon and a caustic ceramic leaching medium at a temperature of at least about 400 degrees F. for a time effective to remove the ceramic material from said component, including positioning an oxygen getter consisting of metallic material in a solid state form in said medium separate from said component and replenishing said oxygen getter periodically by positioning additional said metallic material in said solid state form in said medium in amounts effective to reduce surface corrosion of said component while said ceramic material is being removed therefrom.

2. The method of claim 1 wherein said metallic component is a cast nickel base superalloy component.

3. The method of claim 1 wherein said caustic ceramic leaching medium comprises an aqueous caustic solution.

4. The method of claim 3 wherein the caustic solution comprises a solution of KOH or NaOH present in at least 10 weight % of said solution.

5. The method of claim 1 wherein said caustic ceramic leaching medium comprises a molten caustic salt.

6. The method of claim 5 wherein said caustic leaching medium comprises molten KOH or NaOH at a temperature of at least 400 degrees F.

7. The method of claim 1 wherein said oxygen getter comprises titanium or an alloy of titanium.

8. The method of claim 7 wherein said titanium or alloy thereof is in the form of sponge.

9. The method of claim 1 wherein said component is disposed in a basket that is immersed in the caustic leaching medium and said oxygen getter is present in said basket as a solid metallic material with said component.

10. The method of claim 1 wherein said component is immersed in the caustic ceramic leaching medium disposed in a vessel and said oxygen getter is present as a solid metallic material in said vessel with said caustic ceramic leachng medium.

11. A method of removing a ceramic core from a superalloy component, comprising:

contacting the component having the ceramic core and a caustic ceramic leaching medium at a temperature of at least about 400 degrees F. for a time effective to substantially remove the ceramic core from said component, including positioning an oxygen getter consisting of metallic material in a solid state form in said medium separate from said component and replenishing said oxygen getter periodically by positioning additional said metallic material in said solid state form in said medium in amounts effective to reduce surface corrosion of said component while said ceramic core is being removed therefrom.

12. The method of claim 11 wherein said cast component comprises a cast superalloy airfoil component having a ceramic core residing therein to define a cooling air passage in said component.

13. The method of claim 11 wherein said caustic ceramic leaching medium comprises an aqueous caustic solution.

14. The method of claim 13 wherein the caustic solution comprises a solution of KOH or NaOH present in at least 10 weight % of said solution.

15. The method of claim 11 wherein said caustic ceramic leaching medium comprises a molten caustic salt.

16. The method of claim 15 wherein said caustic ceramic leaching medium comprises molten KOH or NaOH at a temperature of at least 400 degrees F.

17. The method of claim 11 wherein said oxygen getter comprises titanium or an alloy of titanium.

18. The method of claim 17 wherein said titanium or alloy thereof is in the form of sponge.

19. The method of claim 11 wherein said component is disposed in a basket that is immersed in the caustic leaching medium and said oxygen getter is present in said basket as a solid metallic material with said component.

20. The method of claim 11 wherein said component is immersed in the caustic ceramic leaching medium disposed in a vessel and said oxygen getter is present as a solid metallic material in said vessel with said caustic medium.

* * * * *